US007175396B2

(12) United States Patent
Yoon et al.

(10) Patent No.: US 7,175,396 B2
(45) Date of Patent: Feb. 13, 2007

(54) COMPRESSOR

(75) Inventors: Young Seop Yoon, Daejeon (KR); Hew Nam Ahn, Daejeon (KR); Min Joo Lee, Daejeon (KR); Hak Soo Kim, Daejeon (KR)

(73) Assignee: Halla Climate Control Corporation, Daejeon (KR)

( * ) Notice: Subject to any disclaimer, the term of this patent is extended or adjusted under 35 U.S.C. 154(b) by 602 days.

(21) Appl. No.: 10/652,210

(22) Filed: Sep. 2, 2003

(65) Prior Publication Data

US 2004/0091370 A1 May 13, 2004

(30) Foreign Application Priority Data

Sep. 2, 2002 (KR) ..... 10-2002-0052503

(51) Int. Cl.
*F04B 1/12* (2006.01)

(52) U.S. Cl. ..... 417/269

(58) Field of Classification Search ..... 417/269, 417/312

See application file for complete search history.

(56) References Cited

U.S. PATENT DOCUMENTS 5,288,212 A * 2/1994 Lee ..... 417/312
5,556,260 A * 9/1996 Takenaka et al. ..... 417/269
5,645,405 A 7/1997 Ota et al.
5,971,716 A 10/1999 Ota et al.

FOREIGN PATENT DOCUMENTS

| | | |
|---|---|---|
| EP | 1 174 619 | 1/2002 |
| JP | 07-189896 | 7/1995 |
| JP | 08-105381 | 4/1996 |
| JP | 08-254181 | 10/1996 |
| JP | 10-009134 | 1/1998 |
| JP | 2000-120532 | 4/2000 |
| JP | 2000-249059 | 9/2000 |

* cited by examiner

*Primary Examiner*—Anthony D. Stashick
*Assistant Examiner*—Samuel E. Belt
(74) *Attorney, Agent, or Firm*—Lowe Hauptman & Berner, LLP

(57) ABSTRACT

A compressor that inhales refrigerant gas from an external refrigerant circuit, compresses the inhaled refrigerant gas and discharges the compressed refrigerant gas, comprising a cylinder block having a plurality of bores, and a suction muffler chamber having a suction port connected to an external refrigerant circuit installed on the outer circumferential surface of the cylinder block, a front housing coupled to the front side of the cylinder block and forming a crank chamber, a driving shaft supported so as to freely rotate with respect to the cylinder block and the front housing, a single-headed piston connected to a slanting plate element mounted on the driving shaft and linearly reciprocating inside the bores of the cylinder block, and a rear housing connected to and closing the rear side of the cylinder block, having a discharge chamber and a suction chamber, and having two or more suction chamber connecting passages at an upstream side of the suction chamber.

5 Claims, 5 Drawing Sheets

COMPRESSOR

BACKGROUND OF THE INVENTION

1. Field of the Invention

The present invention relates to a compressor used for an air conditioning system for a vehicle, and more particularly to a single-headed piston type compressor having a structure of reducing pressure pulsation of discharged gas.

2. Description of the Related Art

In general, in an air conditioning system for a vehicle, noises are generated due to pressure pulsation of inhaled or discharged gas. In order to reduce a noise transferred to the interior of the vehicle through an evaporator, it is necessary to reduce pressure pulsation of the inhaled gas transferred along a suction line.

In particular, compared to a fixed compressor, a variable compressor operating at a low flow rate of refrigerant in a low lubricating fluid for a long time has an increased noise due to pressure pulsation of the inhaled or discharged gas. Thus, a noise reducing structure is necessary.

In a conventional single-headed piston type variable compressor for a vehicle, a structure of reducing pressure pulsation of inhaled or discharged gas is shown in FIG. 1A and FIG. 1B, in which a suction muffler chamber 1 and a discharge muffler chamber 6 whose open ends face each other are installed on outer circumferential surfaces of a cylinder block 11 and a rear housing 9, and edges of the open ends of the suction and discharge muffler chambers 1 and 6 are connected to each other for sealing. A muffler space enough to reducing pressure pulsation of the inhaled or discharged gas can be obtained without increasing the overall length of the compressor.

In the conventional muffler installed on the outer circumferential surface of a housing, although the overall length of the compressor is not increased, the housing is unavoidably lengthened, resulting in an increase in the overall volume of the compressor. Thus, the conventional muffler cannot be suitably used for a compressor for a vehicle, which must provide the requirement of being small and lightweight.

SUMMARY OF THE INVENTION

The present invention provides a compressor which can reduce pressure pulsation of discharged gas and noise due to the pressure pulsation, while maintaining the overall volume of the compressor.

The present invention also provides a compressor which can reduce pressure pulsation and noise due to the pressure pulsation, while maintaining the overall length and volume of the compressor.

The present invention also provides a compressor which can reduce pressure pulsation of inhaled gas and noise due to the pressure pulsation, while maintaining a space occupied by a discharge chamber inside a rear housing of the compressor.

In an aspect of the present invention, there is provided a compressor that inhales refrigerant gas from an external refrigerant circuit, compresses the inhaled refrigerant gas and discharges the compressed refrigerant gas, comprising a cylinder block having a plurality of bores and a suction muffler chamber having a suction port connected to an external refrigerant circuit installed on the outer circumferential surface of the cylinder block, a front housing coupled to the front side of the cylinder block and forming a crank chamber, a driving shaft supported so as to freely rotate with respect to the cylinder block and the front housing, a single-headed piston connected to a slanting plate element mounted on the driving shaft and linearly reciprocating inside the bores of the cylinder block, and a rear housing connected to and closing the rear side of the cylinder block, having a discharge chamber and a suction chamber, and having two or more suction chamber connecting passages at an upstream side of the suction chamber.

Preferably, a sealing member is interposed between the cylinder block and the rear housing and has at least one connection hole connecting the suction muffler chamber with the suction chamber connecting passages.

The suction port is preferably formed near the front housing so as to be spaced far from the suction chamber connecting passages.

Preferably, the discharge chamber is disposed at the interior side of the rear housing and the suction chamber is disposed at the exterior side of the rear housing.

The refrigerant gas inhaled to the suction muffler chamber through the suction port is preferably divided in opposite directions through the suction chamber connecting passages of the rear housing to then be moved to the suction chamber.

BRIEF DESCRIPTION OF THE DRAWINGS

The above objects and advantages of the present invention will become more apparent by describing in detail preferred embodiments thereof with reference to the attached drawings in which.

DETAILED DESCRIPTION OF THE INVENTION

Figure 1A:
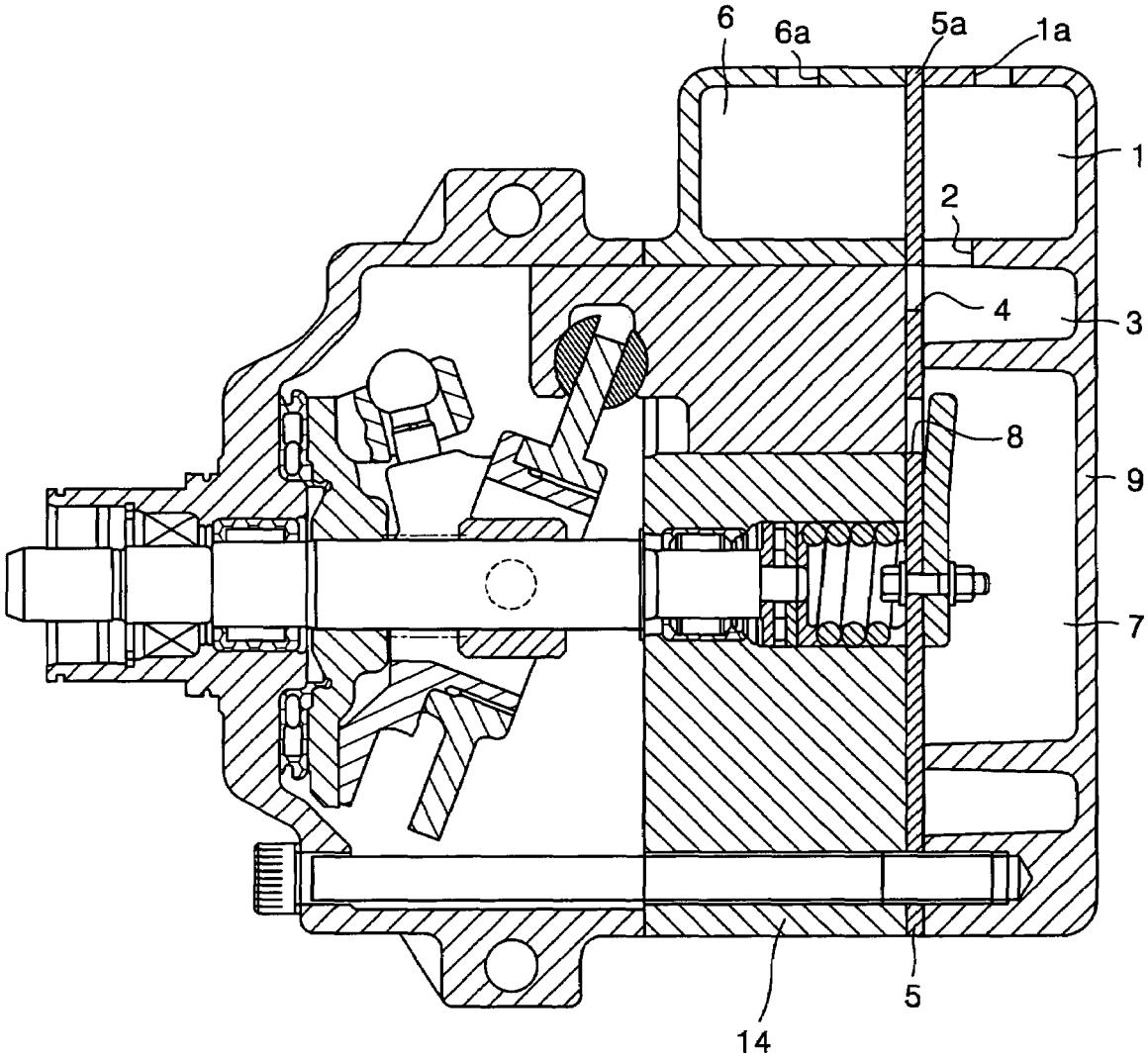
FIG. 1A (PRIOR ART)
FIG. 1A and FIG. 1B are a cross-sectional view and a side view of a conventional compressor.
Figure 1B:
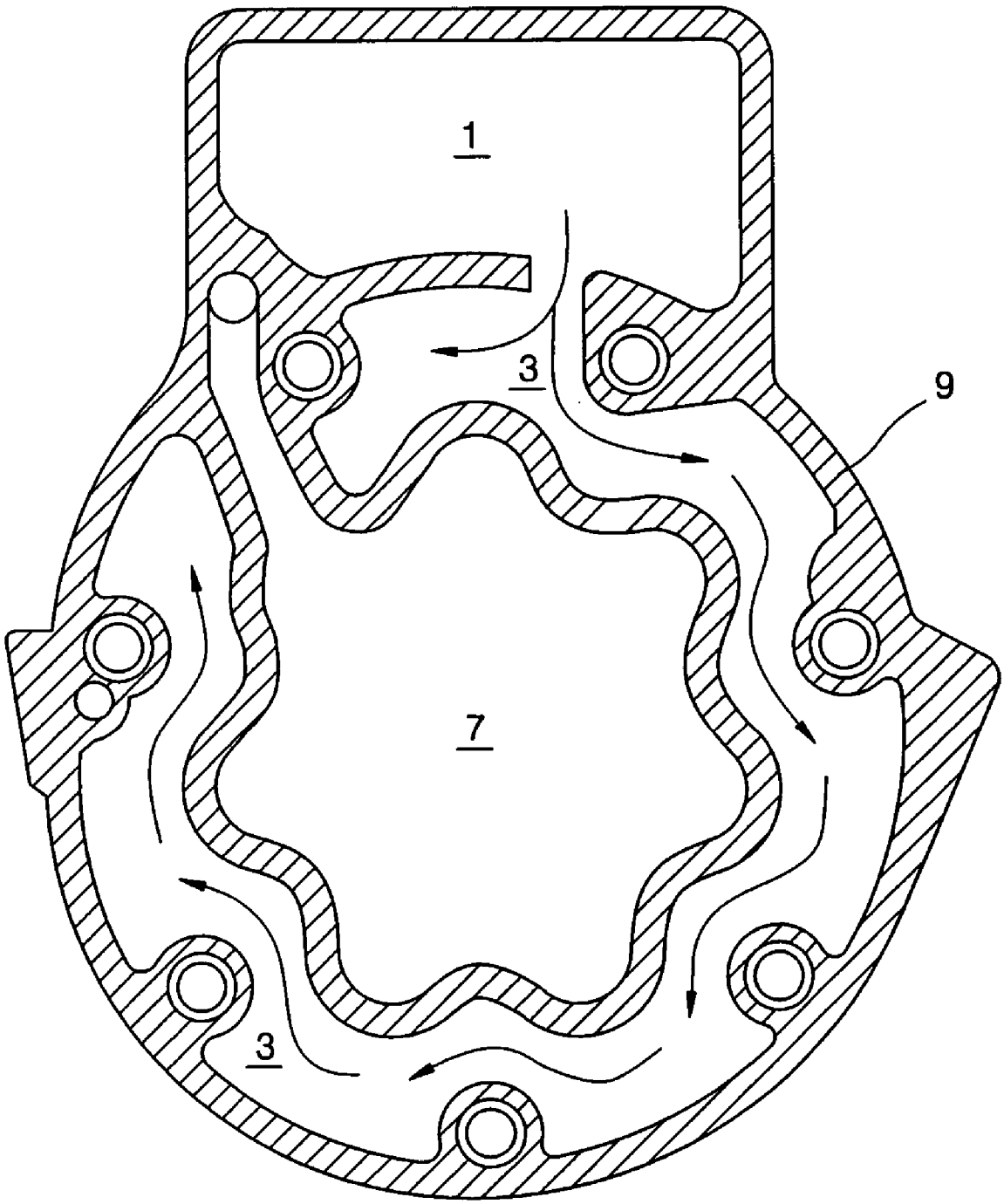
FIG. 1B (PRIOR ART)
Figure 2:
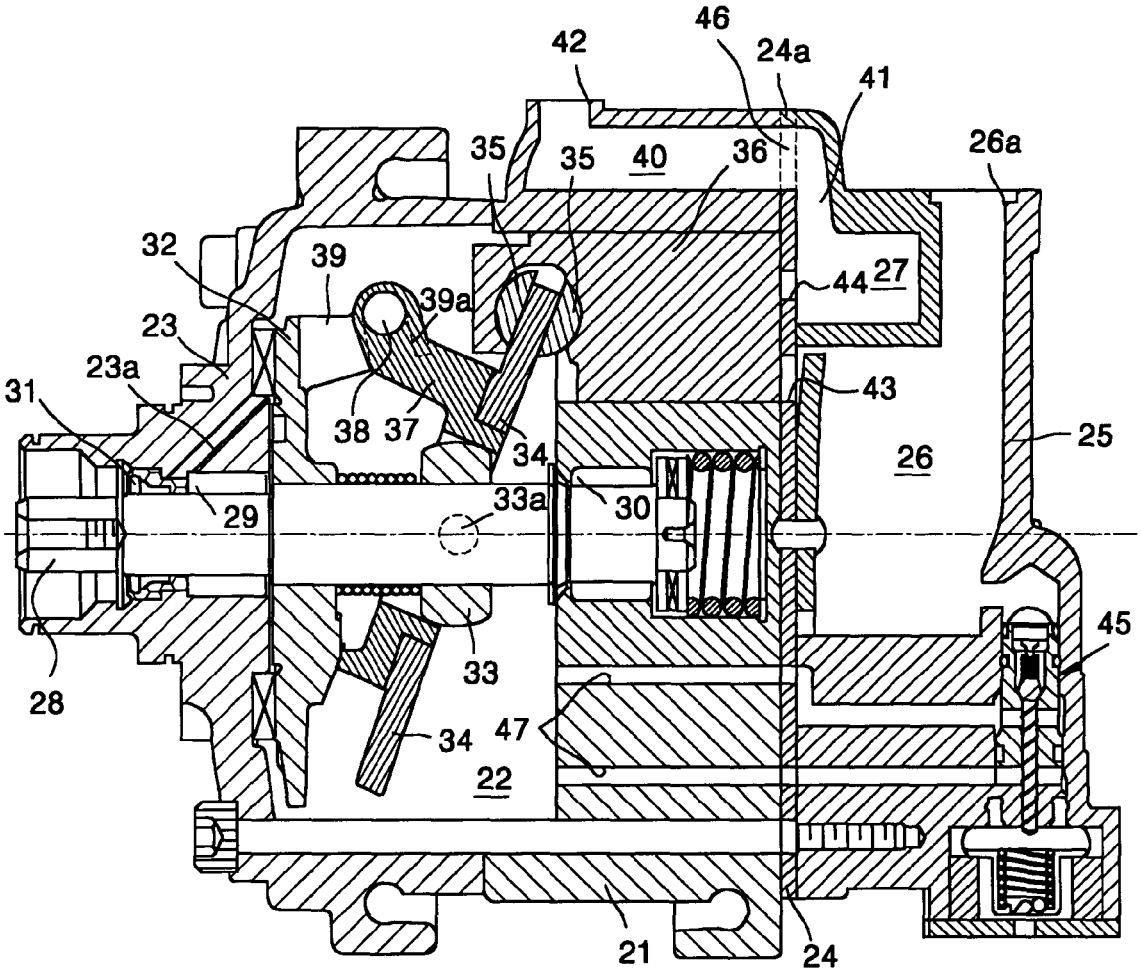
FIG. 2 is a cross-sectional view of a compressor according to the present invention.

Referring to FIG. 2, a cylinder block 21 has at least five bores, the front side of the cylinder block 21 is closed by a front housing 23 having a crank chamber 22, and the rear side thereof is closed by a rear housing 25 having a discharge chamber 26 and a suction chamber 27. The discharge chamber 26 is disposed at the center of the interior of the rear housing 25, so that the refrigerant gas discharged from the cylinder block 21 remains in the discharge chamber 26 before being discharged to the external refrigerant circuit. The suction chamber 27 is provided so as to surround the discharge chamber 26 in the interior of the rear housing 25. A valve plate 24 having discharge holes 43 and suction holes 44 therethrough is positioned between the cylinder block 21 and the rear housing 25.

A shaft sealing device 31 is installed at an extending portion of the front housing side of a driving shaft 28. The driving shaft 28 is supported on the front housing 23 and the cylinder block 21 by radial shaft supports 29 and 30. A rotor 32 is fittingly fixed to the driving shaft 28 inside the crank chamber 22 to transfer rotation of the driving shaft 28 to a swash plate 34. The rotor 32 is rotatably supported on the inner surface of the front housing 23.

A sleeve 33 is fitted to the driving shaft 28 so as to be capable of sliding.

A pin 33*a* is connected between a hole formed at the sleeve 33 and a hole formed at the swash plate 34 so that the swash plate 34 is capable of rotating in a slanting angle.

Flat planes of a pair of hemispherical shoes 35 are contacted at the front and rear sides of a sliding plane of the swash plate 34 respectively so that they are capable of facing each other. Spherical planes of the hemispherical shoes 35 are spherically contacted at insides of hole formed at the single-headed piston 36 inserted into each bore respectively to allow the single-headed piston 36 to lie in the swash plate 34.

A pair of hub arms 37 of a hinge mechanism extend along the top dead center of the swash plate 34 at the front surface of the swash plate 34, and a guide pin 38 penetrating and engaged to each of the hub arms 37 and the rotor 32 is fitted in the hub arm 37 and the rotor 32.

Also, a support arm 39 of the hinge mechanism is installed at the rear surface of the rotor 32 and the guide pin 38 is fitted into a hole 39*a* passing through the support arm 39, thereby regulating movement of the swash plate 34. The hole 39*a* of the support arm 39 has a predetermined central inclination angle so that the top portion of the single-headed piston 36 is maintained at a secured position.

The rotor 32, the sleeve 33 and the swash plate 34 form a slanting plate featuring the present invention.

Reference numeral 45 denotes a capacity volume control valve for controlling the capacity of refrigerant gas inside the crank chamber 22. The capacity volume control value 45 connects the crank chamber 22 with a capacity control passageway 47.

Figure 3:
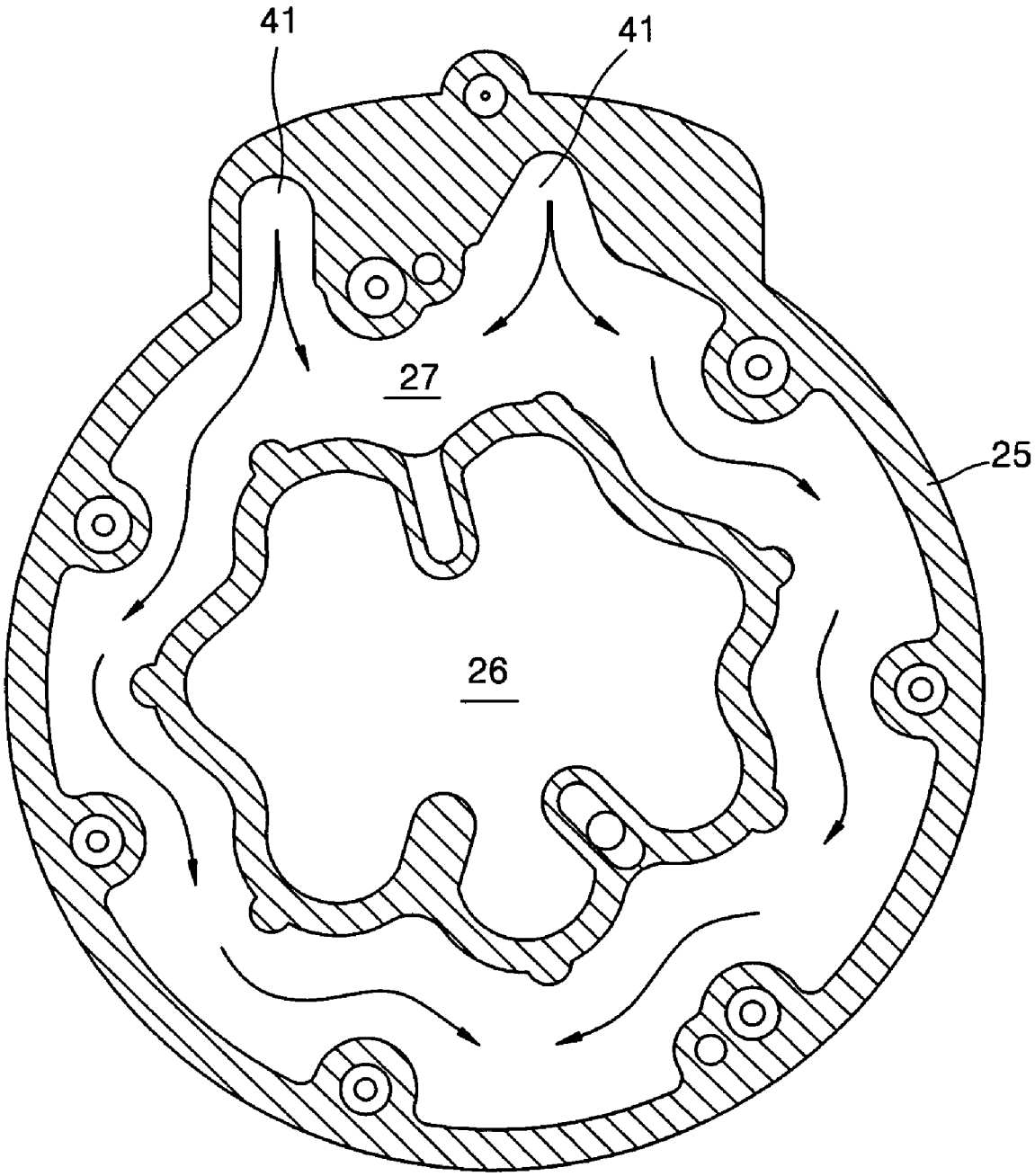
FIG. 3 illustrates a rear housing of the compressor shown in FIG. 2.
Figure 4:
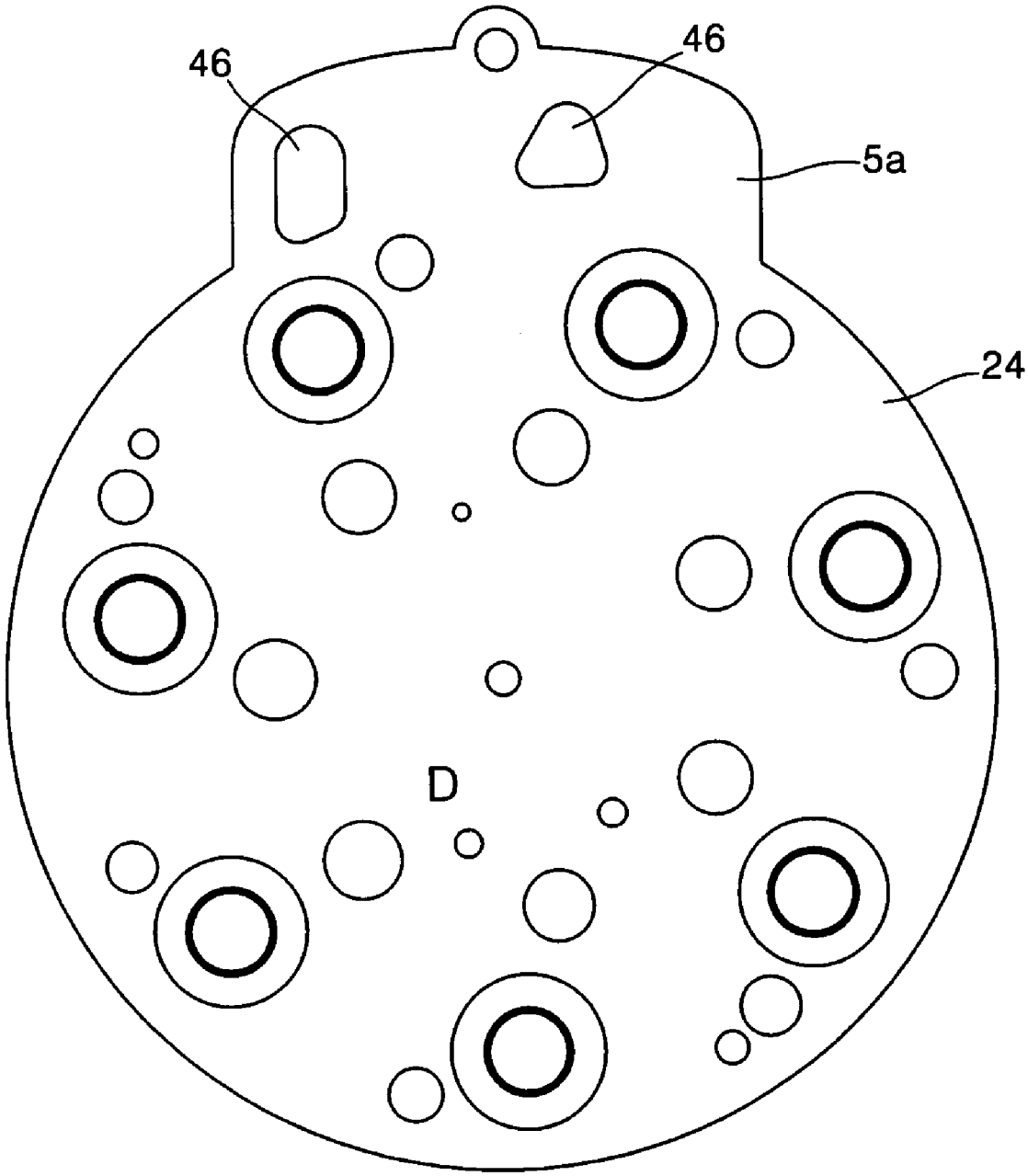
FIG. 4 illustrates a valve plate and a sealing member in the compressor according to the present invention.

According to an aspect of the present invention, a suction muffler chamber 40 having a suction port 42 connected to an external refrigerant circuit is installed on the outer circumferential surface of the cylinder block 21. As shown in FIG. 3, the rear housing 25 has two or more suction chamber connecting passages 41 at an upstream side of the suction chamber 27, the suction chamber connecting passages 41 connecting the suction muffler chamber 40 with the suction chamber 27 of the rear housing 25. Thus, the refrigerant gas of the suction muffler chamber 40 is induced to the suction chamber 27. Here, the number of the suction chamber connecting passages 41 is two, as shown in FIG. 4.

A cross-sectional area of each of the suction chamber connecting passages 41 is preferably smaller than a cross-sectional area of an opening of the suction muffler chamber 40. Further, the suction chamber connecting passages 41*a* are preferably formed in a direction perpendicular to the central axis of the suction chamber 27.

By forming the suction chamber connecting passages 41 at the rear housing 25 in such a manner, the refrigerant gas induced from the suction muffler chamber 40 to the suction chamber 27 of the rear housing 25 passes through the suction chamber connecting passages 41 having a smaller cross-sectional area than the opening of the suction muffler chamber 40 with an increased flow rate. Thus, the refrigerant gas induced to the suction chamber 27 with an increased flow rate can flow throughout the suction chamber 27 rapidly and uniformly, thereby improving inhaling and compressing efficiencies of the refrigerant gas induced from the suction chamber 27 to the crank chamber 22.

Also, flow of refrigerant induced from the suction muffler chamber 40 to the suction chamber 27 can be divided by forming at least two suction chamber connecting passages 41 at the rear housing 25, thereby preventing a drop in the pressure of the refrigerant gas. In other words, in order to allow the refrigerant gas to be induced to the suction chamber 27 rapidly and uniformly, separate suction passageways are provided at the rear housing 25 and the inhaled refrigerant gas is smoothly induced along the passageways, thereby reducing suction resistance of the refrigerant gas.

As shown in FIG. 4, a sealing member 5*a* is interposed between the cylinder block 21 and the rear housing 25.

The sealing member 5*a* preferably has at least one connection hole 46 connecting the suction muffler chamber 40 with the suction chamber connecting passages 41.

The connection hole 46 of the sealing member 5*a* preferably has the same shape as the suction chamber connecting passages 41 so that the refrigerant gas passes through the suction chamber connecting passages 41 smoothly through the connection hole 46 of the sealing member 5*a*, thereby allowing the refrigerant gas to be induced to the suction chamber 27 smoothly.

The suction port 42 formed at the suction muffler chamber 40 is connected to the external refrigerant circuit. The suction port 42 is preferably formed near the front housing 23 so as to be spaced far from the suction chamber connecting passages 41.

In such a manner, the refrigerant gas induced from the external refrigerant circuit to the suction muffler chamber 40 can flow smoothly to the suction chamber 27 of the rear housing 25 without remaining in the suction muffler chamber 40, thereby preventing a drop in the pressure of the refrigerant gas.

The operation of the compressor according to the present invention will now be described.

The refrigerant gas induced from the external refrigerant circuit to the suction muffler chamber 40 through the suction port 42 is inhaled to the suction chamber 27 of the rear housing 25 through the suction chamber connecting passages 41. Here, the refrigerant gas inhaled to the suction muffler chamber 40 through the suction port 42 is divided in opposite directions through the suction chamber connecting passages 41 of the rear housing 25 to then be moved to the suction chamber 27. The thus-inhaled refrigerant gas is compressed by the single-headed piston 36 and the driving shaft 28 and then discharged to the discharge chamber 26 through the discharge holes 43. Then, the refrigerant gas is discharged to the external refrigerant circuit via a discharge port 26*a*.

According to the present invention, the suction muffler chamber 40 is substantially formed only on the outer circumferential surface of the cylinder block 21, that is, the suction muffler chamber 40 is not formed in the rear housing 25. Thus, pressure pulsation of discharged gas and noise due to the pressure pulsation can be effectively reduced while maintaining the overall length of the compressor as well as the overall volume of the compressor.

Also, since the refrigerant inhaled into the suction muffler chamber 40 is induced to the suction chamber 27 through the suction chamber connecting passages 41 of the rear housing 25 in opposite directions, the refrigerant gas can flow rapidly and uniformly from the suction muffler chamber 40 to the suction chamber 27, thereby improving suction and compression efficiency of the refrigerant gas.

While this invention has been particularly shown and described with reference to preferred embodiments thereof, it will be understood by those skilled in the art that various changes in form and details may be made therein without departing from the scope of the invention as defined by the appended claims.

What is claimed is:

1. A compressor that inhales refrigerant gas from an external refrigerant circuit, compresses the inhaled refrigerant gas and discharges the compressed refrigerant gas, comprising:

a cylinder block having a plurality of bores formed to parallel each other in the cylinder block;

a front housing coupled to the front side of the cylinder block and forming a crank chamber;

a driving shaft supported so as to freely rotate with respect to the cylinder block and the front housing;

a single-headed piston connected to a slanting plate element mounted on the driving shaft and linearly reciprocating inside the bores of the cylinder block;

a rear housing connected to a rear side of the cylinder block;

a suction muffler chamber having a suction port connected to an external refrigerant circuit installed on an outer circumferential surface of the cylinder block;

a discharge chamber and a suction chamber formed in the rear housing; and two or more suction chamber connecting passages connecting the suction muffler chamber with the suction chamber at an upstream side of the suction chamber.

2. The compressor of claim 1, wherein a sealing member is interposed between the cylinder block and the rear housing and has at least one connection hole connecting the suction muffler chamber with the suction chamber connecting passages.

3. The compressor of claim 1, wherein the suction port is formed near the front housing so as to be spaced far from the suction chamber connecting passages.

4. The compressor of claim 1, wherein the discharge chamber is disposed at the interior side of the rear housing and the suction chamber is disposed at the exterior side of the rear housing.

5. The compressor of claim 4, wherein the refrigerant gas inhaled to the suction muffler chamber through the suction port is divided in opposite directions through the suction chamber connecting passages of the rear housing to then be moved to the suction chamber.

* * * * *